US008678081B1

(12) United States Patent
Nish

(10) Patent No.: US 8,678,081 B1
(45) Date of Patent: Mar. 25, 2014

(54) COMBINATION ANVIL AND COUPLER FOR BRIDGE AND FRACTURE PLUGS

(75) Inventor: Randall W. Nish, Provo, UT (US)

(73) Assignee: Exelis, Inc., McLean, VA (US)

( * ) Notice: Subject to any disclaimer, the term of this patent is extended or adjusted under 35 U.S.C. 154(b) by 779 days.

(21) Appl. No.: 12/253,337

(22) Filed: Oct. 17, 2008

Related U.S. Application Data

(60) Provisional application No. 61/089,302, filed on Aug. 15, 2008.

(51) Int. Cl.
*E21B 36/02* (2006.01)
*E21B 33/12* (2006.01)

(52) U.S. Cl.
USPC ..... 166/59; 166/386; 166/57; 166/135; 166/192

(58) Field of Classification Search
USPC ..... 166/386, 57, 59, 135, 185, 192
See application file for complete search history.

(56) References Cited

U.S. PATENT DOCUMENTS

| | | | |
|---|---|---|---|
| 1,684,266 | A | 9/1928 | Fisher et al. |
| 2,043,225 | A | 6/1936 | Armentrout et al. |
| 2,160,804 | A | 5/1939 | Hall et al. |
| 2,205,119 | A | 6/1940 | Hall et al. |
| 2,230,712 | A | 2/1941 | Bendeler et al. |
| 2,249,172 | A | 7/1941 | Quintrell |
| 2,338,326 | A | 1/1944 | Green |
| 2,577,068 | A | 12/1951 | Baker |
| 2,589,506 | A | 3/1952 | Morrisett |
| 2,672,199 | A | 3/1954 | McKenna |
| 2,725,941 | A | 12/1955 | Henshaw |
| 2,785,758 | A | 3/1957 | Baker |
| 3,021,902 | A | 2/1962 | Keithahn |
| 3,136,365 | A | 6/1964 | Carter et al. |
| 3,148,731 | A | 9/1964 | Holden |
| 3,163,225 | A | 12/1964 | Perkins |
| 3,211,232 | A | 10/1965 | Grimmer |
| 3,298,440 | A | 1/1967 | Current |
| 3,306,366 | A | 2/1967 | Muse |
| 3,314,480 | A | 4/1967 | Scott |
| 3,420,304 | A | 1/1969 | Kilgore |
| 3,497,003 | A | 2/1970 | Berryman et al. |
| 3,506,067 | A | 4/1970 | Lebourg |
| 3,517,742 | A | 6/1970 | Williams |
| 3,570,595 | A | 3/1971 | Berryman |

(Continued)

OTHER PUBLICATIONS

Baker Hughes Baker Oil Tools Remedial Systems Technical Unit QUIK Drill Composite Bridge Plug and Wireline Adapter Kit PRoduct Family Nos. H40129 and H43848, Feb. 28, 2002, pp. 1-12.
Weatherford FracGuard Composite Plugs, 2004, 7 pages.
BJ Python Composite Bridge Plug, Product Information Sep. 20, 2001, 1 page.

(Continued)

*Primary Examiner* — David Bagnell
*Assistant Examiner* — Elizabeth Gitlin
(74) *Attorney, Agent, or Firm* — Thorpe North & Western LLP

(57) ABSTRACT

A downhole tool such as a bridge or frac plug includes a combination anvil and coupler that forms both the anvil or bottom stop on a mandrel, and a coupler to attach a burn device. One or more members, including a packer ring, can be disposed on the mandrel and movable with respect to the central mandrel along a longitudinal axis of the central mandrel. The combination anvil and coupler includes an upper attachment section attached to the mandrel, an upper surface against which the members are compressed, and a lower attachment section attached to a burn device.

21 Claims, 3 Drawing Sheets

(56) References Cited

U.S. PATENT DOCUMENTS

| | | | |
|---|---|---|---|
| 3,831,677 | A | 8/1974 | Mullins |
| 3,976,133 | A | 8/1976 | Allen |
| 4,099,563 | A | 7/1978 | Hutchison et al. |
| 4,151,875 | A | 5/1979 | Sullaway |
| 4,285,398 | A | 8/1981 | Zandmer et al. |
| 4,289,200 | A | 9/1981 | Fisher, Jr. |
| 4,312,406 | A | 1/1982 | McLaurin et al. |
| 4,359,090 | A | 11/1982 | Luke |
| 4,397,351 | A | 8/1983 | Harris |
| 4,432,418 | A | 2/1984 | Mayland |
| 4,488,595 | A | 12/1984 | Akkerman |
| 4,524,825 | A | 6/1985 | Fore |
| 4,532,989 | A | 8/1985 | Barker |
| 4,542,788 | A | 9/1985 | Semar |
| 4,553,596 | A | 11/1985 | Graham et al. |
| 4,664,188 | A | 5/1987 | Zunkel et al. |
| 4,665,977 | A | 5/1987 | Mullins |
| 4,708,202 | A | 11/1987 | Sukup et al. |
| 4,730,835 | A | 3/1988 | Wilcox et al. |
| 4,739,829 | A | 4/1988 | Brunner |
| 4,745,972 | A | 5/1988 | Bell et al. |
| 4,784,226 | A | 11/1988 | Wyatt |
| 4,813,481 | A | 3/1989 | Sproul et al. |
| 4,834,184 | A | 5/1989 | Streich et al. |
| 4,858,687 | A | 8/1989 | Watson et al. |
| 4,926,938 | A | 5/1990 | Lindsey, Jr. |
| 4,984,636 | A | 1/1991 | Bailey et al. |
| 5,086,839 | A | 2/1992 | Setterberg, Jr. et al. |
| 5,095,978 | A | 3/1992 | Akkerman et al. |
| 5,131,468 | A | 7/1992 | Lane et al. |
| 5,188,182 | A | 2/1993 | Echols, III et al. |
| 5,224,540 | A | 7/1993 | Streich et al. |
| 5,253,709 | A | 10/1993 | Kendrick et al. |
| 5,271,468 | A | 12/1993 | Streich et al. |
| 5,333,684 | A | 8/1994 | Walter et al. |
| 5,340,626 | A | 8/1994 | Head |
| 5,390,737 | A | 2/1995 | Jacobi et al. |
| 5,392,856 | A | 2/1995 | Broussard, Jr. et al. |
| 5,404,956 | A | 4/1995 | Bohlen et al. |
| 5,413,172 | A | 5/1995 | Laurel |
| 5,422,183 | A | 6/1995 | Sinclair et al. |
| 5,441,111 | A | 8/1995 | Whiteford |
| 5,479,986 | A | 1/1996 | Gano et al. |
| 5,540,279 | A | 7/1996 | Branch et al. |
| 5,542,473 | A | 8/1996 | Pringle et al. |
| 5,553,667 | A | 9/1996 | Budde et al. |
| 5,597,784 | A | 1/1997 | Sinclair et al. |
| 5,607,017 | A | 3/1997 | Owens et al. |
| 5,613,560 | A | 3/1997 | Jelinski et al. |
| 5,678,635 | A | 10/1997 | Dunlap et al. |
| 5,701,959 | A | 12/1997 | Hushbeck et al. |
| 5,749,419 | A | 5/1998 | Coronado et al. |
| 5,765,641 | A | 6/1998 | Shy et al. |
| 5,787,979 | A | 8/1998 | Giroux et al. |
| 5,813,457 | A | 9/1998 | Giroux et al. |
| 5,819,846 | A | 10/1998 | Bolt, Jr. |
| 5,837,656 | A | 11/1998 | Sinclair et al. |
| 5,839,515 | A | 11/1998 | Yuan et al. |
| 5,904,207 | A | 5/1999 | Rubbo et al. |
| 5,924,696 | A | 7/1999 | Frazier |
| 5,941,309 | A | 8/1999 | Appleton |
| 5,984,007 | A | 11/1999 | Yuan et al. |
| 5,990,051 | A | 11/1999 | Ischy et al. |
| 6,009,944 | A | 1/2000 | Gudmestad |
| 6,026,903 | A | 2/2000 | Shy et al. |
| 6,056,053 | A | 5/2000 | Giroux et al. |
| 6,076,600 | A | 6/2000 | Vick, Jr. et al. |
| 6,082,451 | A | 7/2000 | Giroux et al. |
| 6,131,663 | A | 10/2000 | Henley et al. |
| 6,145,593 | A | 11/2000 | Hennig |
| 6,167,957 | B1 | 1/2001 | Frazier |
| 6,167,963 | B1 | 1/2001 | McMahan et al. |
| 6,189,618 | B1 | 2/2001 | Beeman et al. |
| 6,220,349 | B1 | 4/2001 | Vargus et al. |
| 6,220,350 | B1 | 4/2001 | Brothers et al. |
| 6,244,642 | B1 | 6/2001 | Serafin et al. |
| 6,279,656 | B1 | 8/2001 | Sinclair et al. |
| 6,318,461 | B1 | 11/2001 | Carisella |
| 6,318,729 | B1 | 11/2001 | Pitto, Jr. et al. |
| 6,354,372 | B1 | 3/2002 | Carisella et al. |
| 6,394,180 | B1 | 5/2002 | Berscheidt et al. |
| 6,412,388 | B1 | 7/2002 | Frazier |
| 6,431,274 | B1 | 8/2002 | Nowlin et al. |
| 6,481,496 | B1 | 11/2002 | Jackson et al. |
| 6,491,108 | B1 | 12/2002 | Slup et al. |
| 6,491,116 | B2 | 12/2002 | Berscheidt et al. |
| 6,540,033 | B1 | 4/2003 | Sullivan et al. |
| 6,578,633 | B2 | 6/2003 | Slup et al. |
| 6,581,681 | B1 | 6/2003 | Zimmerman et al. |
| 6,598,672 | B2 | 7/2003 | Bell et al. |
| 6,598,679 | B2 | 7/2003 | Robertson |
| 6,599,863 | B1 | 7/2003 | Palmer et al. |
| 6,651,738 | B1 | 11/2003 | Solfronk et al. |
| 6,651,743 | B2 | 11/2003 | Szarka |
| 6,655,459 | B2 | 12/2003 | Mackay |
| 6,666,275 | B2 | 12/2003 | Neal et al. |
| 6,695,050 | B2 | 2/2004 | Winslow et al. |
| 6,695,051 | B2 | 2/2004 | Smith et al. |
| 6,708,768 | B2 | 3/2004 | Slup et al. |
| 6,708,770 | B2 | 3/2004 | Slup et al. |
| 6,712,153 | B2 | 3/2004 | Turley et al. |
| 6,732,822 | B2 | 5/2004 | Slack et al. |
| 6,752,209 | B2 | 6/2004 | Mondelli et al. |
| 6,769,491 | B2 | 8/2004 | Zimmerman et al. |
| 6,793,022 | B2 | 9/2004 | Vick et al. |
| 6,796,376 | B2 | 9/2004 | Frazier |
| 6,799,638 | B2 | 10/2004 | Butterfield, Jr. |
| 6,827,150 | B2 | 12/2004 | Luke |
| 6,976,534 | B2 | 12/2005 | Sutton et al. |
| 6,986,390 | B2 | 1/2006 | Doane et al. |
| 7,017,672 | B2 | 3/2006 | Owen, Sr. |
| 7,036,602 | B2 | 5/2006 | Turley et al. |
| 7,044,230 | B2 | 5/2006 | Starr et al. |
| 7,049,272 | B2 | 5/2006 | Sinclair et al. |
| 7,093,664 | B2 | 8/2006 | Todd et al. |
| 7,124,831 | B2 | 10/2006 | Turley et al. |
| 7,163,066 | B2 | 1/2007 | Lehr |
| 7,168,494 | B2 | 1/2007 | Starr et al. |
| 7,210,533 | B2 | 5/2007 | Starr et al. |
| 7,255,178 | B2 | 8/2007 | Slup et al. |
| 7,258,165 | B1 | 8/2007 | Williams |
| 7,273,099 | B2 | 9/2007 | East, Jr. et al. |
| 7,287,596 | B2 | 10/2007 | Frazier et al. |
| 7,322,413 | B2 | 1/2008 | Rogers et al. |
| 7,337,852 | B2 | 3/2008 | Manke et al. |
| 7,350,582 | B2 | 4/2008 | McKeachnie et al. |
| 7,353,879 | B2 | 4/2008 | Todd et al. |
| 7,373,973 | B2 | 5/2008 | Smith et al. |
| 7,380,600 | B2 | 6/2008 | Willberg et al. |
| 7,395,856 | B2 | 7/2008 | Murray |
| 7,452,161 | B2 | 11/2008 | Freyer et al. |
| 7,455,118 | B2 | 11/2008 | Roberts et al. |
| 7,461,699 | B2 | 12/2008 | Richard et al. |
| 7,464,764 | B2 | 12/2008 | Xu |
| 7,475,736 | B2 | 1/2009 | Lehr et al. |
| 7,510,018 | B2 | 3/2009 | Williamson et al. |
| 7,735,549 | B1 | 6/2010 | Nish et al. |
| 7,743,836 | B2 | 6/2010 | Cook et al. |
| 7,789,135 | B2 | 9/2010 | Turley et al. |
| 7,900,696 | B1 | 3/2011 | Nish et al. |
| 7,980,300 | B2 | 7/2011 | Roberts et al. |
| 8,403,036 | B2 | 3/2013 | Neer et al. |
| 2002/0070503 | A1 | 6/2002 | Zimmerman et al. |
| 2002/0162662 | A1 | 11/2002 | Passamaneck et al. |
| 2003/0155112 | A1 | 8/2003 | Tiernan et al. |
| 2003/0188862 | A1 | 10/2003 | Streich et al. |
| 2003/0226660 | A1 | 12/2003 | Winslow et al. |
| 2004/0003928 | A1 | 1/2004 | Frazier |
| 2004/0036225 | A1 | 2/2004 | Ritter et al. |
| 2004/0045723 | A1 | 3/2004 | Slup et al. |
| 2004/0177952 | A1 | 9/2004 | Turley et al. |
| 2005/0077053 | A1 | 4/2005 | Walker et al. |
| 2005/0161224 | A1 | 7/2005 | Starr et al. |
| 2005/0189103 | A1 | 9/2005 | Roberts et al. |

(56) References Cited

U.S. PATENT DOCUMENTS

| | | | | |
|---|---|---|---|---|
| 2005/0205264 | A1 | 9/2005 | Starr et al. | |
| 2006/0124307 | A1 | 6/2006 | Turley et al. | |
| 2006/0131031 | A1 | 6/2006 | McKeachnie et al. | |
| 2006/0278405 | A1 | 12/2006 | Turley et al. | |
| 2007/0039160 | A1 | 2/2007 | Turley et al. | |
| 2007/0074873 | A1 | 4/2007 | McKeachnie et al. | |
| 2007/0102165 | A1 | 5/2007 | Slup et al. | |
| 2007/0119600 | A1 | 5/2007 | Slup et al. | |
| 2007/0284097 | A1 | 12/2007 | Swor et al. | |
| 2007/0284114 | A1 | 12/2007 | Swor et al. | |
| 2008/0047717 | A1 | 2/2008 | Frazier et al. | |
| 2008/0060821 | A1 | 3/2008 | Smith et al. | |
| 2008/0073074 | A1 | 3/2008 | Frazier | |
| 2008/0073081 | A1 | 3/2008 | Frazier et al. | |
| 2008/0073086 | A1* | 3/2008 | Cook et al. | 166/387 |
| 2008/0202764 | A1 | 8/2008 | Clayton et al. | |
| 2008/0257549 | A1* | 10/2008 | Swor et al. | 166/256 |
| 2009/0000792 | A1 | 1/2009 | Turley et al. | |
| 2009/0038790 | A1 | 2/2009 | Barlow | |
| 2009/0044957 | A1 | 2/2009 | Clayton et al. | |
| 2009/0065194 | A1 | 3/2009 | Frazier | |
| 2009/0065216 | A1 | 3/2009 | Frazier | |
| 2009/0078647 | A1 | 3/2009 | Frazier et al. | |
| 2009/0139720 | A1 | 6/2009 | Frazier | |
| 2009/0159274 | A1 | 6/2009 | Frazier | |
| 2009/0178808 | A1 | 7/2009 | Williamson et al. | |
| 2010/0024703 | A1 | 2/2010 | Zampioello et al. | |
| 2010/0155050 | A1 | 6/2010 | Frazier | |
| 2010/0276159 | A1 | 11/2010 | Mailand et al. | |
| 2010/0282004 | A1 | 11/2010 | Nance et al. | |
| 2010/0288487 | A1 | 11/2010 | Turley et al. | |
| 2011/0079383 | A1 | 4/2011 | Porter et al. | |

OTHER PUBLICATIONS

Halliburton FAS Drill Squeeze Packers, Drillable Tools, 1999, 6 page.

Weatherford Completion Systems FracGuard Series Composite Frac Plug 2001, Brochure No. 432.00 & 433.00; 2 pages.

BioBalls MR, Soluble Ball Sealers, www.santrol.com, Applicant believes that the Bioballs were offered for sale prior to the filed of applicant's application.

Nish, et al., U.S. Appl. No. 12/253,319, filed Oct. 17, 2008.

Nish, et al., U.S. Appl. No. 12/353,655, filed Jan. 14, 2009.

Jason Jon Vogel, et al., U.S. Appl. No. 12/549,652, filed Aug. 28, 2009.

Composite Plugs, Magnum Oil Tools International; 19 pages.

U.S. Appl. No. 13/362,185, filed Jan. 31, 2012; Randall W. Nish; office action issued May 2, 2012.

U.S. Appl. No. 12/549,652, filed Aug. 28, 2009; Jason Jon Vogel; office action issued Apr. 18, 2012.

U.S. Appl. No. 12/549,652, filed Aug. 28, 2009; Jason Jon Vogel; notice of allowance issued May 23, 2012.

U.S. Appl. No. 12/353,655, filed Jan. 14, 2009; Randall W. Nish; Notice of Allowance issued Nov. 2, 2011.

U.S. Appl. No. 12/549,652, filed Aug. 28, 2009; Jason Vogle; Office Action issued Nov. 9, 2011.

U.S. Appl. No. 13/362,185, filed Jan. 31, 2012; Randal W. Nish; office action dated Aug. 29, 2012.

U.S. Appl. No. 13/176,107, filed Jul. 5, 2011; Nish; office action dated Sep. 11, 2013.

U.S. Appl. No. 12/916,095, filed Oct. 29, 2010; Randall William Nish; office action dated Mar. 20, 2013.

* cited by examiner

COMBINATION ANVIL AND COUPLER FOR BRIDGE AND FRACTURE PLUGS

RELATED APPLICATIONS

This is related to U.S. patent application Ser. No. 11/800,448, filed May 3, 2007; which is hereby incorporated by reference.

This is related to U.S. Provisional Patent Application Ser. No. 61/089,302, filed Aug. 15, 2008; which is hereby incorporated by reference.

This is related to U.S. patent application Ser. No. 12/253,319, filed Oct. 15, 2008, entitled "Downhole Tool with Exposable and Openable Flow-Back Vents"; which is hereby incorporated by reference.

BACKGROUND

1. Field of the Invention

The present invention relates generally to well completion devices and methods for completing wells, such as natural gas and oil wells. More particularly, this invention relates to a well completion plug that facilitates use of a combustion device.

2. Related Art

Just prior to beginning production, oil and natural gas wells are completed using a complex process called "fracturing." This process involves securing the steel casing pipe in place in the well bore with cement. The steel and cement barrier is then perforated with shaped explosive charges. The surrounding oil or gas reservoir is stimulated or "fractured" in order to start the flow of gas and oil into the well casing and up to the well head. This fracturing process can be repeated several times in a given well depending on various geological factors of the well, such as the depth of the well, size and active levels in the reservoir, reservoir pressure, and the like. Because of these factors, some wells may be fractured at only a few elevations along the well bore and others may be fractured at as many as 30 or more elevations.

As the well is prepared for fracturing at each desired level or zone of the well, a temporary plug is set in the bore of the steel well casing pipe just below the level where the fracturing will perforate the steel and cement barrier. When the barrier is perforated, "frac fluids" and sand are pumped down to the perforations, and into the reservoir. At least a portion of the fluids and sand are then drawn back out of the reservoir in order to stimulate movement of the gas or oil at the perforation level. Use of the temporary plug prevents contaminating the already fractured levels below.

This process is repeated several times, as the "frac" operation moves up the well bore until all the desired levels have been stimulated. At each level, the temporary plugs are usually left in place, so that they can all be drilled out at the end of the process, in a single, but often time-consuming drilling operation. One reason the drilling operation has been time intensive is that the temporary plugs have been made of cast iron which has generally required many hours and, occasionally, several passes of the drilling apparatus to completely drill out the plug. To reduce the drill out time, another type of down hole plug has been developed that is made of a composite material. Composite plugs are usually made of, or partially made of, a fiber and resin mixture, such as fiberglass and high performance plastics. Due to the nature of the composite material, composite plugs can be easily and quickly drilled out of a well bore in a single pass drilling operation.

Alternatively, it has been proposed to combust or burn the plug or a portion thereof in order to eliminate its obstruction in the well casing.

Temporary well plugs used in the fracturing operation described above, whether made of cast iron or composite materials, often come in two varieties, bridge plugs and frac plugs. Bridge plugs restrict fluid movement in the upward and downward direction. Bridge plugs are used to temporarily or permanently seal off a level of the well bore. Frac plugs generally behave as one-way valves that restrict fluid movement down the well bore, but allow fluid movement up the well bore.

In use, when frac fluids and sand are pumped down to a newly perforated level of the well bore, a frac plug set in the well bore just below the perforation level can restrict the frac fluids and sand from traveling farther down the well bore and contaminating lower fractured levels. However, when the frac fluid and sand mixture is pumped back up the well to stimulate the reservoir at the newly fractured level, the one-way valve of the frac plug can open and allow gas and oil from lower levels to be pumped to the well head. This is advantageous to the well owner because it provides immediate revenue even while the well is still being completed. This upward flow can also assist in drilling out the plugs.

SUMMARY OF THE INVENTION

It has been recognized that it would be advantageous to develop a downhole tool, such as a bridge or frac plug, that facilitates the use of a combustion device. In addition, it has been recognized that it would be advantageous to develop a downhole tool that is field configurable as a bridge or frac plug.

The invention provides a downhole tool device with a combination anvil and coupler. A central mandrel is sized and shaped to fit within a well bore and including a hollow therein. At least one member is disposed on the central mandrel and movable with respect to the central mandrel along a longitudinal axis of the central mandrel. The at least one member includes a packer ring compressible along the longitudinal axis of the central mandrel to form a seal between the central mandrel and the well bore. The combination anvil and coupler is attached to a bottom of the mandrel and has an upper attachment section attached to the mandrel, an upper surface against which the at least one member is compressible, a lower attachment section configured to be attached to a burn device, and a hollow therethrough.

In accordance with a more detailed aspect of the present invention, the combination anvil and coupler further includes an intermediate section between the upper and lower attachment sections including at least one vent hole extending from the hollow to an exterior of the combination anvil and coupler.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein:

(FIG. 3 is also an exploded perspective view of the downhole tool or fracture plug of FIG. 4*a* without the ball valve assembly);

Figure 1A:
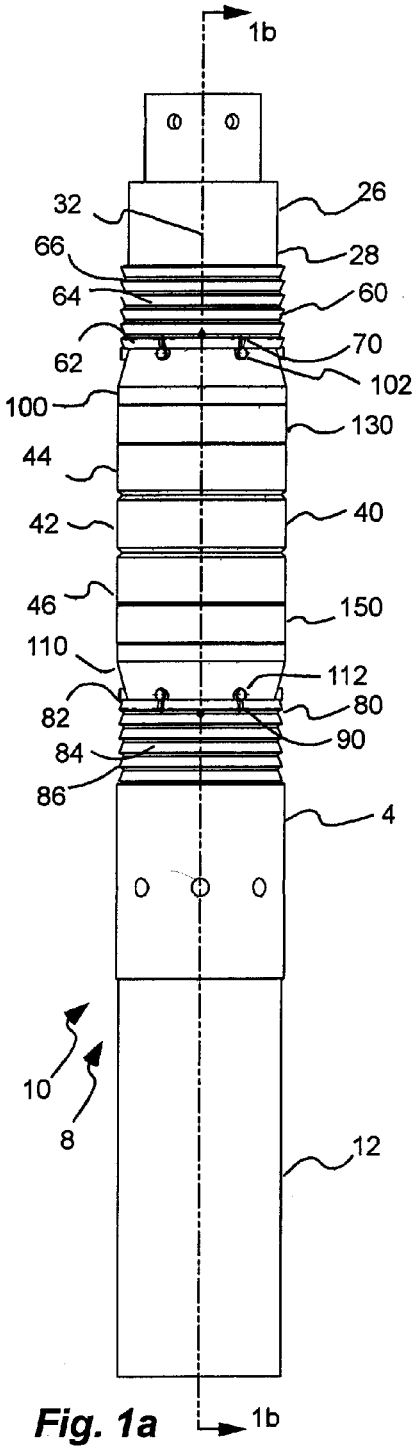
FIG. 1*a* is a side view of a downhole tool or bridge plug with a coupler in accordance with an embodiment of the present invention, and shown with a burn device installed thereon.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIGS. 1*a*-4, a remotely deployable, disposable, consumable down hole flow control device, indicated generally at 10, in accordance with an embodiment of the present invention is shown for use in a well bore as a down hole tool or plug. The down hole flow control device 10 can be remotely deployable at the surface of a well and can be disposable so as to eliminate the need to retrieve the device. One way the down hole flow control device 10 can be disposed is by drilling or machining the device out of the well bore after deployment. Another way the down hole flow control device 10 can be disposed is by combusting or burning all or some of the components thereof using a burn device. Thus, the down hole flow control device 10 can be used as a down hole tool such as a frac plug, indicated generally at 6 and shown in FIGS. 4*a* and 4*b*, a bridge plug, indicated generally at 8 and shown in FIGS. 1*a*-3, a cement retainer (not shown), well packer (not shown), a kill plug (not shown), and the like in a well bore as used in a gas or oil well. The down hole flow control device 10 includes a central mandrel 20 with a hollow 24 that can extend axially, or along a longitudinal axis of the mandrel, throughout a length of the device to form a flow path for well fluids depending on the use of the device, such as when configured as a frac plug 6. In addition, the hollow can receive a burn device to facilitate combustion of the mandrel and/or plug. Alternatively, the hollow 24 may not extend the length of the mandrel 20.

A burn device 12 can be attached to the down hole flow control device 10 to selectively cause the device or various components to burn and fall down the well bore to the "rat hole." The burn device can be attached to the mandrel 20 with a combination anvil and coupler 4, as described in greater detail below. The burn device can include fuel, oxygen, an igniter and a control or activation system that allow the burn device to combust the flow control device 10. The burn device 12 can be attached to a bottom of the mandrel 20, and can be inserted into the hollow 24.

The central mandrel 20 can be sized and shaped to fit within a well bore, tube or casing for an oil or gas well. The central mandrel 20 can have a cylindrical body 22 with a hollow 24 or hollow center that can be open on a proximal or upper end 26. The upper end 26 of the mandrel can include a threaded bore 27 to receive a plug insert 208 or valve assembly insert 204 (FIGS. 4*a* and 4*b*)), as described in greater detail below. The upper end can also include an enlarged top stop 28. In addition, a distal or lower end 30 of the mandrel can include a threaded connection 31, such as a threaded nipple. The body 22 can be sized and shaped to fit within a well bore and have a predetermined clearance distance from the well bore wall or casing.

The central mandrel 20 can be formed of a material that is easily drilled or machined, such as cast iron, fiber and resin composite, and the like. In the case where the central mandrel 20 is made of a composite material, the fiber can be rotationally wound in plies having predetermined ply angles with respect to one another and the resin can have polymeric properties suitable for extreme environments, as known in the art. In one aspect, the composite article can include an epoxy resin with a curing agent. Additionally, other types of resin devices, such as bismaleimide, phenolic, thermoplastic, and the like can be used. The fibers can be E-type and ECR type glass fibers as well as carbon fibers. It will be appreciated that other types of mineral fibers, such as silica, basalt, and the like, can be used for high temperature applications. Alternatively, the mandrel 20 can be formed of material that is combustible, such as magnesium, aluminum or the like.

Figure 2:
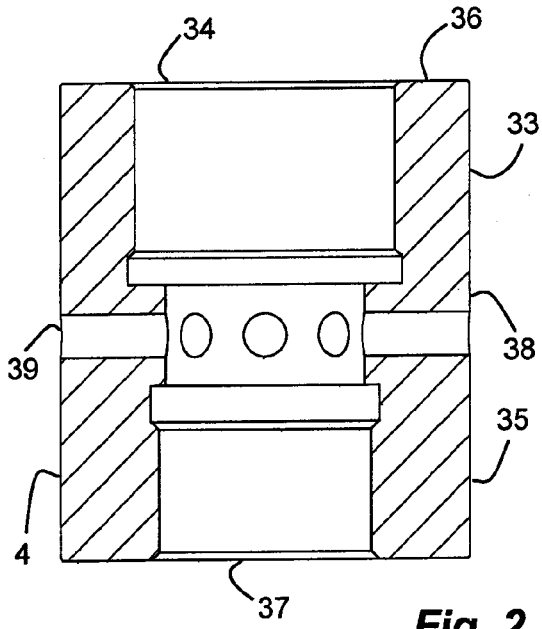
FIG. 2 is a cross-sectional side view of the coupler of FIG. 1*a;*

Referring to FIG. 2, the combination anvil and coupler 4 is attached to the bottom 30 of the mandrel 20. The coupler 4 can have an upper attachment section 33 with a threaded bore 34 to receive the threaded connection 31 or nipple of the mandrel. Thus, the coupler 4 can be threaded onto the mandrel. The coupler also includes an upper surface 36 and has a larger diameter than body of the mandrel to form an anvil against which other members on the mandrel are compressed, as discussed more fully below. The coupler 4 can include a lower attachment section 35 with a threaded bore 37 to attach to the burn device. For example, a threaded connection or nipple of the burn device can be threaded onto the coupler 4 to attach the burn device to the plug or mandrel. The coupler 4 can be formed of a single, unitary body, or a monolithic body. Thus, the combination anvil and coupler 4 forms both a coupler between the plug or mandrel and the burn device, but also forms the anvil or lower stop of the plug. The combination anvil and coupler reduces part count and allows plugs or mandrels to be configured with a burn device as desired. The coupler 4 can be hollow therethrough along the longitudinal axis. A portion of the burn device can extends through the hollow of the coupler, through the intermediate section, and into the hollow of the mandrel. The inner diameter of the intermediate section can be greater than the outer diameter of the portion of the burn device passing therethrough to facilitate the flow of fluid through the vent hole, as shown in FIG. 1*c*. The coupler can also include an intermediate section 38 between the upper and lower attachment sections with one or more vent holes 39. The vent holes 39 can facilitate combustion of the plug or mandrel. In addition, the vent holes can allow fluids to pass the plug when configured as a frac plug 6.

Referring again to FIGS. 1*a*-3, one or more members are disposed on the central mandrel 20 and movable with respect to the central mandrel along a longitudinal axis 32 of the central mandrel. The members can include at least one packer ring (or a set of packer rings) that are compressible along the axis and expandable radially to form a seal between the mandrel and the well bore; at least one fracturable slip ring (or a pair of slip rings) to fracture and displace radially to secure the plug in the well bore; at least one cone (or a pair of cones) to slid between the slip ring and the mandrel to cause the slip ring to fracture and displace radially; etc.

A compressible packer ring 40 can be disposed on the cylindrical body 22 of the central mandrel 20. The packer ring 40 can have an outer diameter just slightly smaller than the diameter of the well bore. The packer ring 40 can be compressible along the longitudinal axis 32 of the central mandrel 20 and radially expandable in order to form a seal between the central mandrel 20 and the well bore. The packer ring 40 can be formed of an elastomeric polymer that can conform to the shape of the well bore or casing and the central mandrel 20.

In one aspect, the packer ring 40 can be formed of three rings, including a central ring 42 and two outer rings 44 and 46 on either side of the central ring. In this case, each of the three rings 42, 44, and 46 can be formed of an elastomeric material having different physical properties from one another, such as durometer, glass transition temperatures, melting points, and elastic modulii, from the other rings. In this way, each of the rings forming the packer ring 40 can withstand different environmental conditions, such as temperature or pressure, so as to maintain the seal between the well bore or casing over a wide variety of environmental conditions.

An upper slip ring 60 and a lower slip ring 80 can also be disposed on the central mandrel 20 with the upper slip ring 60 disposed above the packer ring 40 and the lower slip ring 80 disposed below the packer ring 40. Each of the upper and lower slip rings 60 and 80 can include a plurality of slip segments 62 and 82, respectively, that can be joined together by fracture regions 64 and 84 respectively, to form the rings 62 and 82. The fracture regions 64 and 84 can facilitate longitudinal fractures to break the slip rings 60 and 80 into the plurality of slip segments 62 and 82. Each of the plurality of slip segments can be configured to be displaceable radially to secure the down hole flow control device 10 in the well bore.

The upper and lower slip rings 60 and 80 can have a plurality of raised ridges 66 and 86, respectively, that extend circumferentially around the outer diameter of each of the rings. The ridges 66 and 86 can be sized and shaped to bite into the well bore wall or casing. Thus, when an outward radial force is exerted on the slip rings 60 and 80, the fracture regions 64 and 84 can break the slip rings into the separable slip segments 62 and 82 that can bite into the well bore or casing wall and wedge between the down hole flow control device and the well bore. In this way, the upper and lower slip segments 62 and 82 can secure or anchor the down hole flow control device 10 in a desired location in the well bore.

The upper and lower slip rings 60 and 80 can be formed of a material that is easily drilled or machined so as to facilitate easy removal of the down hole flow control device from a well bore. For example, the upper and lower slip rings 60 and 80 can be formed of a cast iron or composite material. Additionally, the fracture regions 64 and 84 can be formed by stress concentrators, stress risers, material flaws, notches, slots, variations in material properties, and the like, that can produce a weaker region in the slip ring.

In one aspect, the upper and lower slip rings 60 and 80 can be formed of a composite material including fiber windings, fiber mats, chopped fibers, or the like, and a resin material. In this case, the fracture regions can be formed by a disruption in the fiber matrix, or introduction of gaps in the fiber matrix at predetermined locations around the ring. In this way, the material difference in the composite article can form the fracture region that results in longitudinal fractures of the ring at the locations of the fracture regions.

In another aspect, the upper and lower slip rings 60 and 80 can be formed of a cast material such as cast iron. The cast iron can be machined at desired locations around the ring to produce materially thinner regions such as notches or longitudinal slots 70 and 90 in the ring that will fracture under an applied load. In this way, the thinner regions in the cast iron ring can form the fracture region that results in longitudinal fractures of the ring at the locations of the fracture regions. In another aspect, the upper and lower slip rings 60 and 80 can be formed of a material that is combustible.

In yet another aspect, the upper and lower slip rings 60 and 80 can also have different fracture regions 64 and 84 from one another. For example, the fracture regions 64 and 84 can include longitudinal slots spaced circumferentially around the ring, the longitudinal slots 90 of the lower slip ring 80 can be larger than the slots 70 of the upper slip ring 60. Thus, the fracture regions 84 of the lower slip ring 80 can include less material than the fracture regions 64 of the upper slip ring 60. In this way, the lower slip ring 80 can be designed to fracture before the upper slip ring 60 so as to induce sequential fracturing with respect to the upper and lower slip rings 60 and 80 when an axial load is applied to both the upper slip ring and the lower slip ring.

It will be appreciated that compression of the packer ring 40 can occur when the distance between the upper and lower slip rings 60 and 80 is decreased such that the upper and lower slip rings 60 and 80 squeeze or compress the packer ring 40 between them. Thus, if the slip rings fracture under the same load, or at the same approximate time during the compression operation, the distance between the two rings 60 and 80 may not be small enough to have sufficiently compressed the packer ring 40 so as to form an adequate seal between the central mandrel 20 and the well bore or casing wall. In contrast, the sequential fracturing mechanism of the down hole flow control device 10 described above advantageously allows the lower slip ring 80 to set first, while the upper slip ring 60 can continue to move longitudinally along the central mandrel 20 until the upper slip ring 60 compresses the packer ring 40 against the lower slip ring 80. In this way, the lower slip ring 80 sets and anchors the tool to the well bore or casing wall and the upper ring 60 can be pushed downward toward the lower ring 80, thereby squeezing or compressing the packer ring 40 that is sandwiched between the upper and lower slip rings 60 and 80.

The down hole flow control device 10 can also include an upper cone 100 and a lower cone 110 that can be disposed on the central mandrel 20 adjacent the upper and lower slip rings 60 and 80. Each of the upper and lower cones 100 and 110 can be sized and shaped to fit under the upper and lower slip rings 60 and 80 so as to induce stress into the upper or lower slip ring 60 and 80, respectively. The upper and lower cones 100 and 110 can induce stress into the upper or lower slip rings 60 and 80 by redirecting the axial load pushing the upper and lower slip rings together against the anvil combination anvil and coupler 4 to a radial load that can push radially outward from under the upper and lower slip rings. This outward radial loading can cause the upper and lower slip rings 60 and 80 to fracture into slip segments 62 and 82 when the axial load is applied and moves the upper slip ring 60 toward the lower slip ring 80.

The upper and lower cones 100 and 110 can be formed from a material that is easily drilled or machined such as cast iron or a composite material. In one aspect the upper and lower cones 100 and 110 can be fabricated from a fiber and resin composite material with fiber windings, fiber mats, or chopped fibers infused with a resin material. Advantageously, the composite material can be easily drilled or machined so as to facilitate removal of the down hole flow control device 10 from a well bore after the slip segments have engaged the well bore wall or casing. Alternatively, the upper and lower cones 100 and 110 can be formed of a combustible material, such as magnesium or aluminum or the like.

The upper and lower cones 100 and 110 can also include a plurality of stress inducers 102 and 112 disposed about the upper and lower cones. The stress inducers 102 and 112 can be pins that can be set into holes in the conical faces of the upper and lower cones 60 and 80, and dispersed around the circumference of the conical faces. The location of the pins around the circumference of the cones can correspond to the location of the fracture regions 64 and 84 (or the slots) of the upper and lower slip rings 60 and 80. In this way, each stress inducer 102 and 112 can be positioned adjacent a corresponding respective fracture region 64 or 84, respectively, in the upper and lower slip rings. Advantageously, the stress inducers 102 and 112 can be sized and shaped to transfer an applied load from the upper or lower cone 100 and 110 to the fracture regions 64 and 84 of the upper or lower slip rings 60 or 80, respectively, in order to cause fracturing of the slip ring at the fracture region and to reduce uneven or unwanted fracturing of the slip rings at locations other than the fracture regions. Additionally, the stress inducers 102 and 112 can help to move the individual slip segments into substantially uniformly spaced circumferential positions around the upper and lower cones 100 and 110, respectively. In this way the stress inducers 102 and 112 can promote fracturing of the upper and lower slip rings 60 and 80 into substantially similarly sized and shaped slip segments 62 and 82.

The down hole flow control device 10 can also have an upper backing ring 130 and a lower backing ring 150 disposed on the central mandrel 20 between the packer ring 40 and the upper and lower slip rings 60 and 80, respectively. In one aspect, the upper and lower backing rings 130 and 150 can be disposed on the central mandrel 20 between the packer ring 40 and the upper and lower cones 100 and 110, respectively. The upper and lower backing rings 130 and lower 150 can be sized so as to bind and retain opposite ends 44 and 46 of the packer ring 40.

Figure 4A:
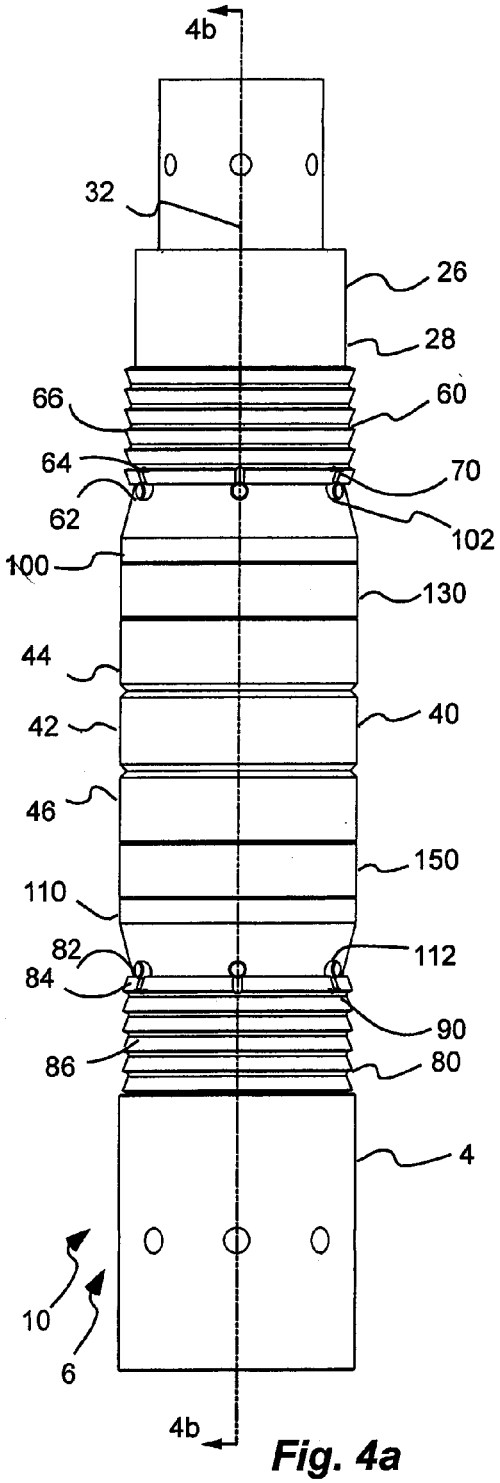
FIG. 4*a* is a side view of a downhole tool or fracture plug with a coupler in accordance with an embodiment of the present invention, and shown without a burn device.
Figure 4B:
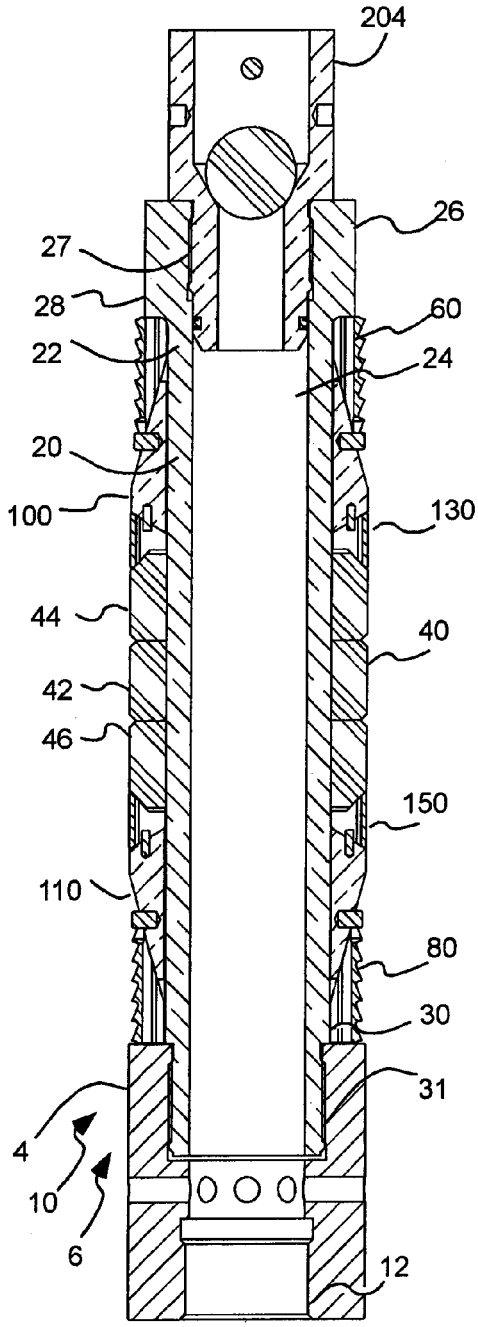
FIG. 4*b* is a cross-sectional side view of the downhole tool or fracture plug with a coupler of FIG. 4*a* taken along line 4*b*-4*b*.

It will be appreciated that the down hole flow control device 10 described herein can be used with a variety of down hole tools. Thus, as indicated above, FIGS. 4*a* and 4*b* show the down hole flow control device 10 used with a frac plug, indicated generally at 6, and FIGS. 1*a*-3 show the down hole flow control device 10 used with a bridge plug, indicated generally at 8. Referring to FIGS. 4*a* and 4*b*, the down hole flow control device, indicated generally at 10 can secure or anchor the central mandrel 20 to the well bore wall or casing so that a one way check valve 204, such as a ball valve, can allow flow of fluids from below the plug while isolating the zone below the plug from fluids from above the plug. Referring to FIGS. 1*a*-3, the down hole flow control device, indicated generally at 10, can secure or anchor the central mandrel to the well bore wall or casing so that a solid plug 208 can resist pressure from either above or below the plug in order to isolate the a zone in the well bore. Advantageously, the down hole flow control device 10 described herein can be used for securing other down hole tools such as cement retainers, well packers, and the like.

Figure 1B:
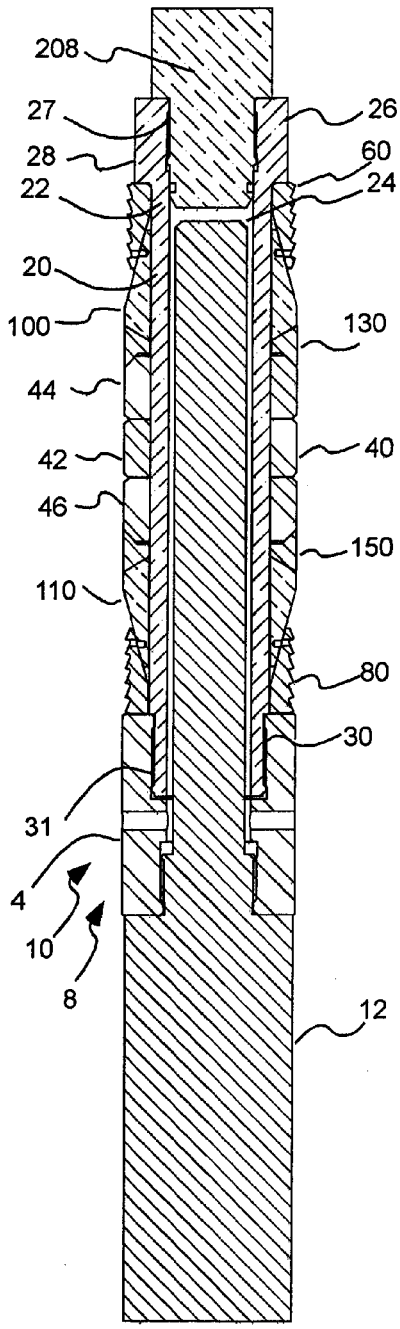
FIG. 1*b* is a cross-sectional view of the downhole tool or bridge plug with a coupler of FIG. 1 taken along line 1*b*-1*b*, also shown with a burn device installed thereon.
Figure 3:
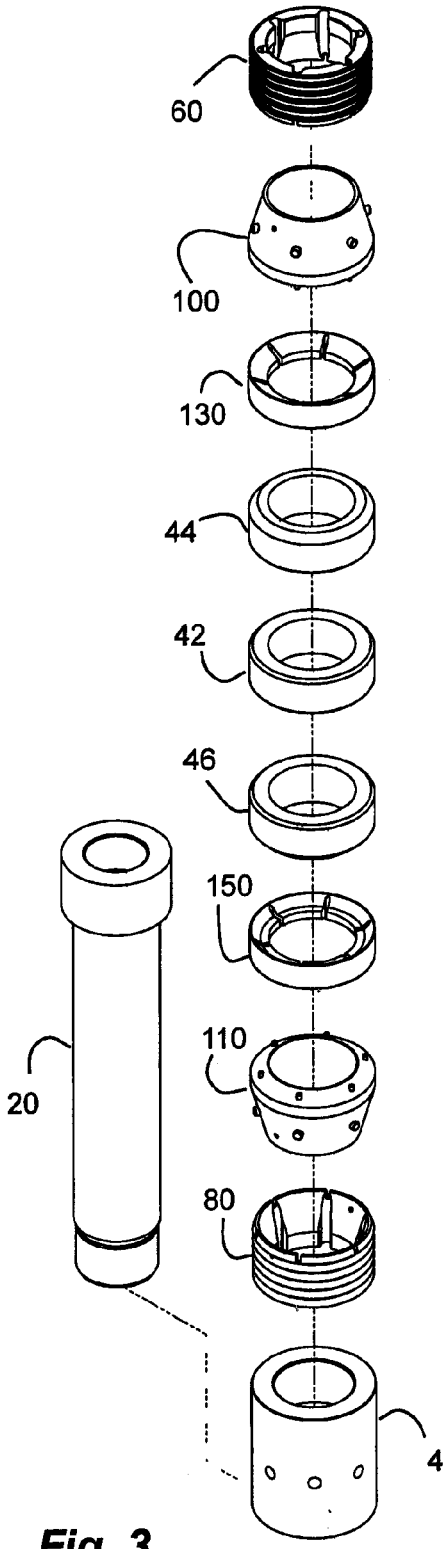
FIG. 3 is an exploded perspective view of the downhole tool or bridge plug of FIG. 1*a*, without the burn device or plug
Figure 1C:
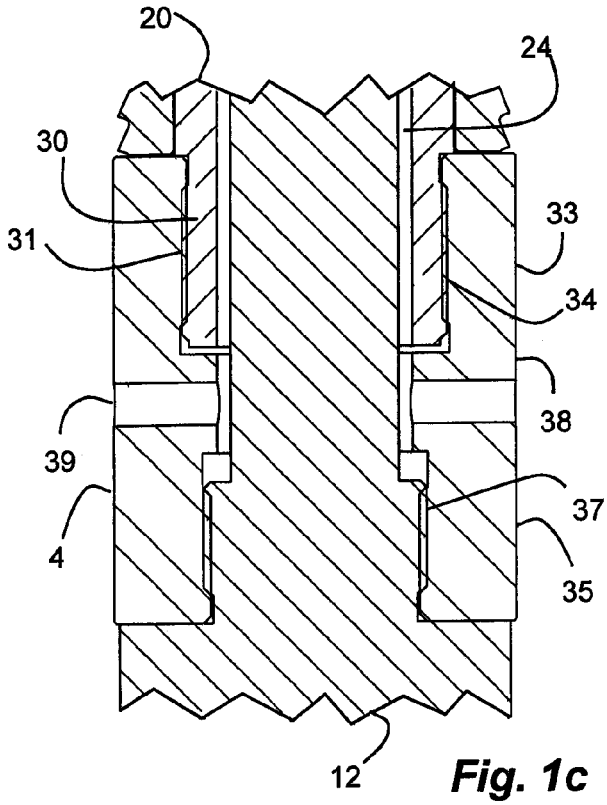
FIG. 1*c* is a partial cross-sectional view of FIG. 1*b* showing the coupler in greater detail.

Referring to FIG. 1*b*, the plug insert 208 includes a body with a threaded connection or nipple that can be threaded into the threaded bore 27 of the mandrel 20 to configure the plug 10 as a bridge plug 8. Referring to FIG. 4*b*, the valve assembly insert 204 also includes a body with a threaded connection or nipple that can be threaded into the threaded bore 27 of the mandrel 20 to configure the plug 10 as a frac plug 6. It will be appreciated that the plug 10 can be configured as desired in the field, i.e. as either a bride plug or a frac plug, by threading in either the plug insert 208 or the valve assembly insert 204. Thus, fewer plug assemblies need to be warehoused.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A downhole tool device, comprising:

a) a central mandrel sized and shaped to fit within a well bore and including a hollow therein;

b) at least one member disposed on the central mandrel and movable with respect to the central mandrel along a longitudinal axis of the central mandrel, the at least one member including a packer ring compressible along the longitudinal axis of the central mandrel to form a seal between the central mandrel and the well bore;

c) a burn device coupled to a bottom of the central mandrel by a coupler;

d) the coupler attached to the bottom of the central mandrel between the burn device and the central mandrel;

e) the coupler having an upper surface forming an anvil against which the at least one member is compressible and a hollow therethrough; and f) the coupler having an intermediate section between upper and lower attachment sections including at least one vent hole extending from the hollow to an exterior of the coupler.

2. A device in accordance with claim 1, further comprising:

a portion of the burn device extending through the hollow of the coupler and into the hollow of the mandrel.

3. A device in accordance with claim 2, wherein an inner diameter of the intermediate section of the coupler at the at least one vent hole is greater than an outer diameter of a portion of the burn device disposed through the intermediate section.

4. A device in accordance with claim 2, wherein the upper attachment section includes a threaded connection attachable to a threaded connection at the bottom of the central mandrel; and wherein the lower attachment section includes a threaded connection attachable to a threaded connection of the burn device.

5. A device in accordance with claim 1, wherein the coupler is a single, unitary body.

6. A device in accordance with claim 1, wherein the central mandrel can receive either 1) a plug insert in the hollow to form a bridge plug, or 2) a valve assembly insert to form a fracture plug.

7. A device in accordance with claim 6, wherein an upper end of the central mandrel includes a threaded bore; and wherein both the plug insert and valve assembly insert include a body with threads to engage the threaded bore.

8. A device in accordance with claim 1, wherein the at least one member further comprises:

a) at least one slip ring disposed on the central mandrel and including a plurality of slip segments joined together by fracture regions to form the slip ring, the fracture regions being configured to facilitate longitudinal fractures to break the slip ring into the plurality of slip segments, and each of the plurality of slip segments being configured to secure the down hole flow control device in the well bore; and b) at least one cone disposed on the central mandrel adjacent the at least one slip ring and being sized and shaped to induce stress into the slip ring to cause the slip ring to fracture into slip segments when an axial load is applied to the slip ring.

9. A device in accordance with claim 1, wherein the coupler further comprises:

a lower attachment section with a threaded bore configured to be attached to a burn device.

10. A device in accordance with claim 1, wherein the downhole tool device is field configurable as either a bridge plug or a frac plug with either a plug insert or valve assembly insert, respectively, having a body connected to a bore in an upper end of the mandrel.

11. A downhole tool device, comprising:

a) a central mandrel sized and shaped to fit within a well bore and including a hollow therein;

b) at least one member disposed on the central mandrel and movable with respect to the central mandrel along a longitudinal axis of the central mandrel, the at least one member including a packer ring compressible along the longitudinal axis of the central mandrel to form a seal between the central mandrel and the well bore;

c) a coupler attached to a bottom of the mandrel and the coupler having:

an upper attachment section attached to the mandrel, an upper surface forming an anvil against which the at least one member is compressible, a lower attachment section, a hollow therethrough, an intermediate section between the upper and lower attachment sections;

at least one vent hole extending from the hollow to an exterior of the coupler; and d) a burn device attached to the lower attachment section of the coupler with a portion of the burn device extending through the hollow of the coupler and into the hollow of the mandrel.

12. A device in accordance with claim 11, wherein an inner diameter of the intermediate section of the coupler at the at least one vent hole is greater than an outer diameter of a portion of the burn device disposed through the intermediate section.

13. A device in accordance with claim 11, wherein the coupler is a monolithic body.

14. A device in accordance with claim 11, wherein the central mandrel can receive either 1) a plug in the hollow to form a bridge plug, or 2) a valve assembly to form a fracture plug.

15. A device in accordance with claim 14, wherein an upper end of the central mandrel includes a threaded bore; and wherein both the plug insert and valve assembly insert include a body with threads to engage the threaded bore.

16. A device in accordance with claim 11, wherein the at least one member further comprises:

a) at least one slip ring disposed on the central mandrel and including a plurality of slip segments joined together by fracture regions to form the slip ring, the fracture regions being configured to facilitate longitudinal fractures to break the slip ring into the plurality of slip segments, and each of the plurality of slip segments being configured to secure the down hole flow control device in the well bore; and b) at least one cone disposed on the central mandrel adjacent the at least one slip ring and being sized and shaped to induce stress into the slip ring to cause the slip ring to fracture into slip segments when an axial load is applied to the slip ring.

17. A device in accordance with claim 11, wherein the coupler further comprises:

a lower attachment section with a threaded bore configured to be attached to a burn device.

18. A method for attaching a burn device to a downhole tool, comprising:

obtaining a downhole tool including at least one member movably disposed on a central mandrel sized and shaped to fit within a well bore and having a hollow therein, the at least one member including a packer ring compressible along a longitudinal axis of the mandrel to form a seal between the central mandrel and the well bore;

attaching a coupler to a bottom of the mandrel with the coupler having an upper attachment section for attachment to the mandrel, an upper surface forming an anvil against which the at least one member is compressible, a lower attachment section, a hollow therethrough, and at least one vent hole extending from the hollow to an exterior of the coupler; and attaching a burn device to the lower attachment section of the coupler with a portion of the burn device extending through the hollow of the coupler and into the hollow of the mandrel.

19. A method in accordance with claim 18, further comprising:

causing the burn device to activate and combust the central mandrel; and allowing combustion gas to flow through the at least one vent hole in the coupler.

20. A method in accordance with claim 18, further comprising:

threading a body of either a plug insert or a valve assembly insert into a threaded bore at an upper end of the central mandrel.

21. A downhole tool device, comprising:

a) a central mandrel sized and shaped to fit within a well bore and including a hollow therein;

b) at least one packer ring disposed on the central mandrel and movable with respect to the central mandrel along a longitudinal axis of the central mandrel, and compressible along the longitudinal axis of the central mandrel to form a seal between the central mandrel and the well bore;

c) a pair of cones disposed on the central mandrel on opposite ends of the at least one packer ring;

d) a pair of slip rings disposed on the central mandrel on opposite ends of the at least one packer ring, and displaceable radially by the pair of cones to secure the downhole tool in the well bore;

e) a coupler attached to a bottom of the mandrel and the coupler comprising:

an upper attachment section attached to the mandrel, an upper surface having a larger diameter than the mandrel to form an anvil against which the at least one packer ring, the pair of cones and the pair of slip rings are compressible, a lower attachment section with a threaded bore configured to be attached to a burn device, and a hollow therethrough;

an intermediate section between the upper and lower attachment sections;

at least one vent hole extending from the hollow to an exterior of the coupler; and f) the burn device attached to the lower attachment section of the coupler with a portion of the burn device extending through the hollow of the coupler and into the hollow of the mandrel;

g) a threaded bore in an upper end of the central mandrel receiving either 1) a plug insert to form a bridge plug, or 2) a valve assembly insert to form a fracture plug; and h) both the plug insert and the valve assembly insert include a body with threads to engage the threaded bore.

* * * * *